United States Patent [19]

Ruehl et al.

[11] Patent Number: 4,774,115

[45] Date of Patent: Sep. 27, 1988

[54] BITUMINOUS STRIP FOR BRIDGE-SEALING

[75] Inventors: Karl Ruehl, Bad Nauheim; Ernst Scherp, Bruchkoebel, both of Fed. Rep. of Germany

[73] Assignee: Ruetgerswerke Aktiengesellschaft, Frankfurt, Fed. Rep. of Germany

[21] Appl. No.: 100,387

[22] Filed: Sep. 24, 1987

[30] Foreign Application Priority Data

Oct. 3, 1986 [DE] Fed. Rep. of Germany ..... 3633648

[51] Int. Cl.[4] ..... B05D 3/06; B32B 7/10; B32B 11/00; C09J 7/02; D06N 7/04

[52] U.S. Cl. ..... 428/55; 427/44; 428/57; 428/60; 428/78; 428/291; 428/349; 428/354; 428/440; 428/489

[58] Field of Search ..... 427/44; 428/55, 57, 428/60, 78, 291, 349, 354, 440, 489

[56] References Cited

U.S. PATENT DOCUMENTS

| | | | |
|---|---|---|---|
| 4,210,693 | 7/1980 | Regan et al. | 427/44 |
| 4,333,866 | 6/1982 | Uffner | 428/440 |
| 4,405,689 | 9/1983 | Watanabe | 428/440 |
| 4,413,019 | 11/1983 | Brenner | 427/44 |
| 4,420,524 | 12/1983 | Georgati | 428/291 |
| 4,440,816 | 4/1984 | Uffner et al. | 428/291 |
| 4,528,241 | 7/1985 | Uffner et al. | 428/291 |
| 4,530,652 | 7/1985 | Buck et al. | 428/291 |
| 4,600,635 | 7/1986 | Wiercinski et al. | 428/489 |
| 4,714,651 | 12/1987 | Hartmann et al. | 428/291 |

FOREIGN PATENT DOCUMENTS

| | | | |
|---|---|---|---|
| 221002 | 4/1985 | German Democratic Rep. . | |
| 129263 | 11/1978 | Japan | 428/440 |

*Primary Examiner*—James C. Cannon

*Attorney, Agent, or Firm*—Beveridge, DeGrandi & Weilacher

[57] ABSTRACT

A high-temperature resistant sealing strip for bridge-sealing is prepared from a strip with a cover substance containing a mixture of bitumen and a radiation-cross-linking polymer in the ratio of 7/3 to 19/1 and which is crosslinked in an electron accelerator at an irradiation dose between 5 and $16 \times 10^4$ Gy.

8 Claims, 1 Drawing Sheet

BITUMINOUS STRIP FOR BRIDGE-SEALING

The present invention relates to a bituminous strip to seal bridges.

BACKGROUND OF THE INVENTION

Effective insulation against moisture is required between the bridge structural elements and the vehicular road bed coatings. Accordingly, the concrete surface is customarily coated with bitumen, and upon this coat there will then be bonded a bituminous sealing strip. Finally, a protective layer of poured asphalt and a cover decking layer are usually placed on top of the sealing layer.

As a rule the poured asphalt, which is at a temperature between 220° and 250° C., will be put in place manually. Due to the high temperatures involved road beds made of pure of polymer-modified bitumen cannot be used. The molten cover decking layer of the sealing strips mixes with the poured asphalt by boiling through and thereby softens it.

Thermoplastic polymer sheets, for example based on polyvinyl chloride, have insufficient thermal resistance. Elastomeric sheets have been observed to produce folds due to the heat, and while these folds to a certain extent can be averted by paper covering, these folds result in a slippery layer forming between the concrete slab and the vehicular road bed cover (BITUMEN-TEERE-ASPHALTE-PECHE, 1972, pp 170–5).

Therefore it had previously been proposed to form bituminous sealing strips for sealing bridges the top side of which is laminated with an embossed aluminum sheet (German OLS No. 21 48 448). It is known, however, that aluminum sheets are corroded by condensation salts. And other metal sheets, for instance, of high-grade steel, are very expensive.

SUMMARY OF THE INVENTION

The object of the present invention is to provide an economical bituminous sealing strip for bridge-sealing which achieves full-surface bonding between the bridge construction elements proper and the layer of asphalt without endangering the softening of the latter.

In achieving the above and other objects of the invention, one feature resides in a sealing strip made of polymer-modified bituminous materials and comprising a reinforcing inset, at least the upper cover layer formed of a bitumen modified with a radiation-crosslinking polymer which is crosslinked in three dimensions by an electron beam.

BRIEF DESCRIPTION OF DRAWING

The present invention will be further understood with reference to the drawings, wherein.

DETAILED DESCRIPTION OF INVENTION

The present invention is illustratively shown in two embodiments in the accompanying drawings and is described in further detail below.

Figure 1:
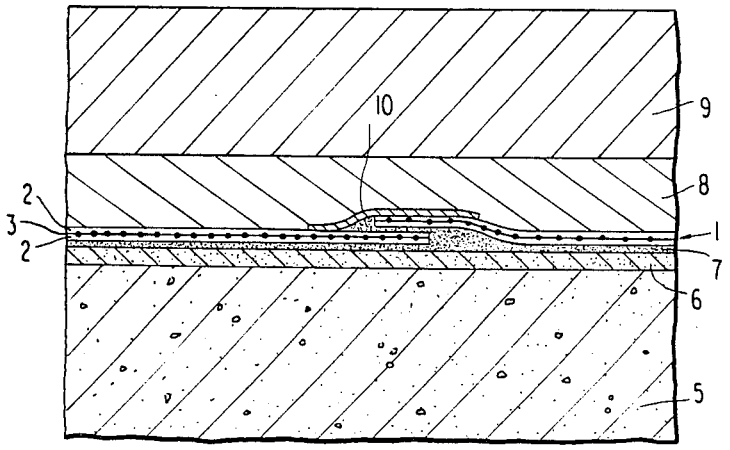
FIG. 1 is a cross-sectional view of a bridge seal formed in accordance with the invention.

As shown in FIG. 1 a cross-section of a bridge-seal, the bare sealing strips (1) are bonded over their full surface and in overlapping manner with a hot bitumen material, such as that identified in the art as 100/25 (7), onto a concrete slab (5) having a bituminous pre-coating (6). The sealing strip (1) is formed of a glass fabric (3) provided on both sides with a bituminous cover layer (2) about 2 mm thick. The cover decking material contains 63 parts by weight of bitumen B200, 7 parts by weight polybutadiene and 30 parts by weight polybutadiene and 30 parts by weight mineral fillers, and following formation of the sealing strip is crosslinked at $10\times10^4$ Gy using an electron beam. The softening point, as determined by the RuK method, thereby rises from 64° to 205° C. To prevent the hot bitumen used as adhesive from boiling out of the overlap seams even in careless work, the seams are additionally bonded with crepe paper adhesive tapes (10).

A poured-asphalt protective layer (8) 30 mm thick and at 240° C. is manually deposited on the sealing strips. Over that, in turn, a poured-asphalt cover decking layer (9) is then deposited. The sealing strip (1) therefore bonds both with the hot bitumen (7) and with the poured asphalt (8) without the cover decking layers (9) being subjected to the danger of melting.

Figure 2:
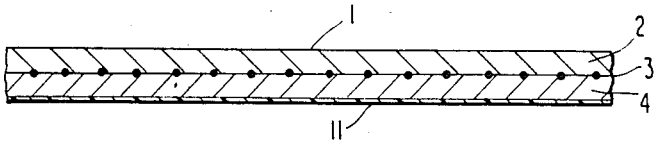
FIG. 2 is a cross-sectional view of a sealing strip provided with a fusing seam in accordance with the invention.

Besides being coated with a hot-melt bitumen (7), the sealing strip (1) also can be fused onto the concrete slab (5) provided with a bituminous pre-coating (6). There are two possibilities in this regard: either the fusing layer (4) is deposited on the cover layer (2), or, as shown in FIG. 2, fusing layer (4) can be directly bonded onto the lower side of the reinforcing inset (3) made of a fiber glass web. Because the fusing lange (4) also retains its bonding strength after irradiation, the strip is provided with a separating or parting means on its underside. In addition to the known parting means such as a deposit of finely divided mineral layer, a thin, easily melting polypropylene foil (11) will be especially suitable for this purpose because during the fusing it will mix with the hot-melt bitumen. The sealing strip is manufactured in conventional manner in a roofing strip plant in thicknesses between 3 and 6 mm. Before being coiled, the strip passes through an electron accelerator or is treated with gamma rays. The radiation dose should be at least $5\times10^4$ Gy to achieve adequate crosslinking. Because some degradation takes place during irradiation with hard gamma rays used in crosslinking, and furthermore because the dosing is not rigorously accurate and the cost for protective means is very high, crosslinking preferably is carried out using electron beams. A detailed description of making the sealing strip is contained in the copending application Ser. No. 100,386 filed Sept. 24, 1987.

Especially as regards thick strips, the fusing seam may be deposited after the irradiation to save on radiation energy.

All radiation-crosslinking, natural and synthetic rubbers may be used for purposes of the present invention as the polymers so long as they are bitumen-compatible. Illustratively, polybutadiene, styrene-butadiene rubber and crosslinking polyolefins such as polyethylene can be used. The ratio of bitumen to crosslinking polymer is about 7/3 to 19/1, preferably 4/1 to 9/1. While the properties are further improved when the rubber proportion of the mixture exceeds 15%, the high resulting viscosity however will make it impossible to produce it in a conventional plant for roofing strips. In that event more costly manufacturing methods are required, for example employing calenders.

The softening point (RuK) of the radiation-crosslinking, polymer-modified bitumen is above 180° C. When heated to 150° C. (as measured in sealing strips), no oil or bitumen is expelled. Therefore, the cover decking layer will not melt when the poured-asphalt protective layer is installed, and the asphalt cannot soften. The cover decking layer is resistant to condensation salts. Furthermore, the bond with the poured asphalt is substantially stronger than in the metal-asphalt bond. Vapor bubbles due to any moist scattering material cannot arise in the deposition of the poured asphalt because only bare sealing strips are used, or those laminated with a thin, easily melting plastic foil, for instance of polypropylene.

The following examples are illustrative of the present invention.

EXAMPLE 1

A web of polyester fibers (230 g/m$^2$) is impregnated with a substance consisting of 9 parts by weight of distilled bitumen B 200 and 1 part by weight of styrene-butadiene rubber and is provided on both sides with a 2 mm layer of 63 parts by weight of bitumen B 200, 7 parts by weight of styrene-butadiene rubber and 30 parts by weight of slate dust with grain size $<100$ $\mu$m. The surfaces are powdered with talc. Thereupon, the strip is crosslinked in an electron accelerator at a radiation of $16\times10^4$ Gy. Strip samples are removed before and after radiation to ascertain the cold stability according to DIN 52123 and the softening point (RuK) according to DIN 52011. The results are set forth in the table herein.

EXAMPLE 2

A Fiberglass fabric (200 g/m$^2$) is impregnated with a mixture of 4 parts by weight of bitumen B 200 and 1 part by weight polyethylene. The top side is coated 3 mm thick with a mixture of 16 parts by weight of bitumen B 200, 4 parts by weight polyethylene and 5 parts by weight of slate dust, and the lower side is coated 1 mm thick with blown bitumen 100/25. The top and bottom sides are laminated with a thin sheet of polypropylene. The strip is crosslinked using radiation of $6\times10^4$ Gy. The test results are shown in the table.

TABLE

| Modifying Agent | | Polybutadiene | styrene-butadiene rubber | Polyethylene |
|---|---|---|---|---|
| Softening point (RuK) (°C.) | before crosslinking | 64 | 120 | 120 |
| | after crosslinking | 205 | 180 | 185 |
| Cold-stability down to (°C.) | before crosslinking | −30 | −30 | −10 |
| | after crosslinking | −50 | −40 | −20 |

Further variations and modifications of the present invention will be apparent to those skilled in the art from the foregoing and are intended to be encompassed by the claims appended hereto.

We claim:

1. A sealing strip comprising a reinforcing insert layer having an upper surface and an underside surface and being coated with polymer-modified bitumens, wherein at least the upper layer (2) is coated with a bitumen modified by a radiation-crosslinking polymer and is crosslinked three-dimensionally by electron radiation.

2. The sealing strip as defined in claim 1, wherein the radiation-crosslinking polymer is a rubber.

3. The sealing strip as defined in claim 1, wherein the radiation-crosslinking polymer is a polyolefin.

4. The sealing strip as defined in claim 1 wherein the radiation-crosslinking upper layer is a bituminous substance having a ratio of bitumen to polymer from 7/3 to 19/1, preferably between 4/1 and 9/1.

5. The sealing strip as defined in claim 1 which is crosslinked by radiation between $5\times10^4$ and $16\times10^4$ Gy.

6. The sealing strip as defined in claim 1 wherein a bituminous fusing layer is coated on its underside.

7. Sealing means comprising a plurality of strip members (1) in overlapping adjacent arrangement, said strip members being formed of a centrally located insert web or fabric of heat resistant material, coated on each side thereof with a bituminous coating formed of a bitumen and a crosslinkable synthetic polymer, said strip having been subjected to crosslinking radiation using an electron beam operating with a dose of $5\times10^4$ to $16\times10^4$ Gy, a paper adhesive tape being placed on top of the overlapping edges of said plurality of strips.

8. The sealing means as defined in claim 7 which further comprise a poured asphalt layer (8) deposited over top of said plurality of strip members (1).

* * * * *